United States Patent [19]

Tushner et al.

[11] 4,177,590

[45] Dec. 11, 1979

[54] PICTURE FRAME ASSEMBLY

[75] Inventors: Lawrence P. Tushner; Walter J. Krol, both of Chicago, Ill.

[73] Assignee: Intercraft Industries Corporation, Chicago, Ill.

[21] Appl. No.: 941,002

[22] Filed: Sep. 11, 1978

[51] Int. Cl.[2] ..... G09F 1/12

[52] U.S. Cl. ..... 40/156

[58] Field of Search ..... 40/152, 154, 156, 10 R

[56] References Cited

U.S. PATENT DOCUMENTS

| | | | |
|---|---|---|---|
| 648,523 | 5/1900 | Pierce | 40/156 |
| 683,711 | 10/1901 | Silverberg | 40/152 |
| 2,051,129 | 8/1936 | Clayton | 247/25 |
| 2,614,354 | 10/1952 | Winslow | 40/156 |
| 2,633,653 | 4/1953 | Angus et al. | 40/156 |
| 2,970,397 | 2/1961 | Roseman | 40/156 |
| 2,985,977 | 5/1961 | Roseman | 40/156 |
| 3,095,661 | 7/1963 | Ellis | 40/156 |
| 3,132,431 | 5/1964 | Petrie | 40/125 |
| 3,557,478 | 1/1971 | Sitzberger | 40/1.5 |
| 3,613,280 | 10/1971 | Tuchinsky et al. | 40/155 |
| 3,694,947 | 10/1972 | Mukai et al. | 40/151 |
| 3,745,680 | 7/1973 | Faust | 40/156 |
| 3,901,496 | 8/1975 | Chambers | 267/160 |
| 3,996,682 | 12/1976 | Schwartz | 40/156 |
| 4,037,342 | 7/1977 | Bott | 40/10 R |
| 4,045,898 | 9/1977 | Reinhardt | 40/156 |

*Primary Examiner*—Louis G. Mancene
*Assistant Examiner*—Wenceslao J. Contrera
*Attorney, Agent, or Firm*—Vogel, Dithmar, Stotland, Stratman & Levy

[57] ABSTRACT

The assembly comprises a frame having end and side frame members, each such member including an outside wall. An inclined rear wall and a front lip extend inwardly from the outside wall. An inside wall extends rearwardly from the front lip and has a rear end constituting a ledge for a glass pane, a picture and the like. Each of at least two retaining strips associated with at least two of the frame members has a side wall carrying an inwardly directed flange and an inclined tongue. A retaining strip is applied by inserting the tongue between the rear wall and the outside wall, then pushing the retaining strip toward such outside wall until the flange rests on the backing for the picture.

15 Claims, 12 Drawing Figures

PICTURE FRAME ASSEMBLY

BACKGROUND OF THE INVENTION

Frames for large pictures and paintings must be particularly strong. Frames constructed of materials such as wood and extruded metals and plastics are very capable of retaining their shape and are suitable to be used to make large frames. However, such materials are expensive and the frames produced thereby are heavy. Sheet metal is, on the other hand, an inexpensive material and also is of light weight construction, but heretofore sheet metal has been reliably usable only in smaller frames where strength is not an important factor.

It has been learned that there are certain advantages to be gained by a construction enabling the picture, the glass pane (if used), and the backing (if used) to be dropped into place from the back as opposed to introducing the elements through one end and then sliding them into place. For example, in a drop-in type frame, filler materials between the backing and the picture are unnecessary. Also, a slide-in frame requires the ends of the side frame members to be sheared to create a mouth for the glass pane, picture, backing, etc. A rear drop-in frame, on the other hand, requires no such sheared ends. However, means heretofore employed for retaining the elements in place for a drop-in type frame have been attachable and detachable with some difficulty and often required the use of a tool. Furthermore, they have not been as strong as necessary to be utilized with large pictures.

SUMMARY OF THE INVENTION

It is therefore an important object of the present invention to provide a frame assembly which is constructed of sheet metal, yet is strong enough to be usable in large formats.

Another object is to provide a frame assembly in which the glass pane, picture, backing and the like are dropped in through the back rather than being slid into place through one end, and retained in place with readily attachable and detachable retaining means.

Another object is to permit application of the retaining means without the use of tools and to permit detachment of such retaining means with a coin or other readily available "tool."

Another object is to provide a picture frame assembly in which the hanger elements are integral with the retaining means.

In summary, there is provided a frame assembly for displaying a picture or the like and comprising a frame having a pair of end frame members and a pair of side frame members, each of said frame members including an outside wall having a rear and a front, a rear wall on the rear of said outside wall and being inclined inwardly and forwardly therefrom, a front lip on the front of the outside wall and extending inwardly therefrom, and an inside wall on the inside of the front lip and extending rearwardly therefrom, the rear of the inside wall being located forwardly of the front of the rear wall and defining a ledge for means including the picture; and at least two retaining strips respectively associated with two of the frame members, each of the retaining strips including a side wall having a front and a rear, a flange on the front of the side wall and extending inwardly therefrom, and a tongue on the rear of the side wall and being inclined outwardly and rearwardly therefrom, each of the retaining strips being applied by inserting its tongue in the space between the associated outside and rear walls and then pushing the retaining strip toward the associated outside wall until the associated flange rests on the rear of the means.

The invention consists of certain novel features, and a combination of parts hereinafter fully described, illustrated in the accompanying drawings, and particularly pointed out in the appended claims, it being understood that various changes in the details may be made without departing from the spirit, or sacrificing any of the advantages, of the invention.

BRIEF DESCRIPTION OF THE DRAWINGS

For the purpose of facilitating an understanding of the invention, there is illustrated in the accompanying drawings, one preferred embodiment thereof, from an inspection of which, when considered in connection with the following description, the invention, its construction, and operation, and many of its advantages should be readily understood and appreciated.

DESCRIPTION OF THE PREFERRED EMBODIMENT

Figure 1:
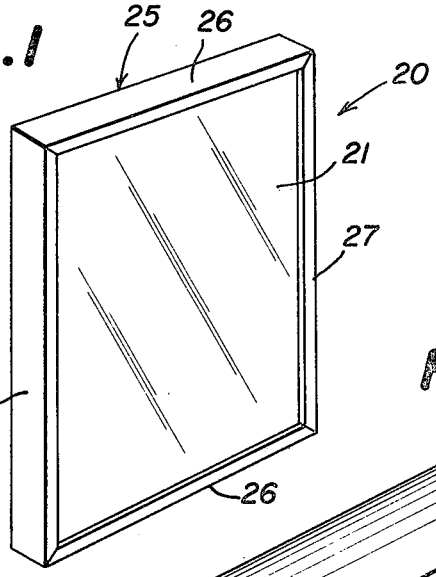
FIG. 1. is a perspective view of a picture frame assembly incorporating the features of the present invention.

Turning now to the drawings, and more particularly to FIG. 1 thereof, there is shown a frame assembly 20 incorporating the features of the present invention. The frame assembly 20 includes a glass pane 21 and a backing 22. A picture (not shown) is inserted between the pane 21 and the backing 22. The frame assembly 20 includes a frame 25 having two end frame members 26 and two side frame members 27.

Figure 3:
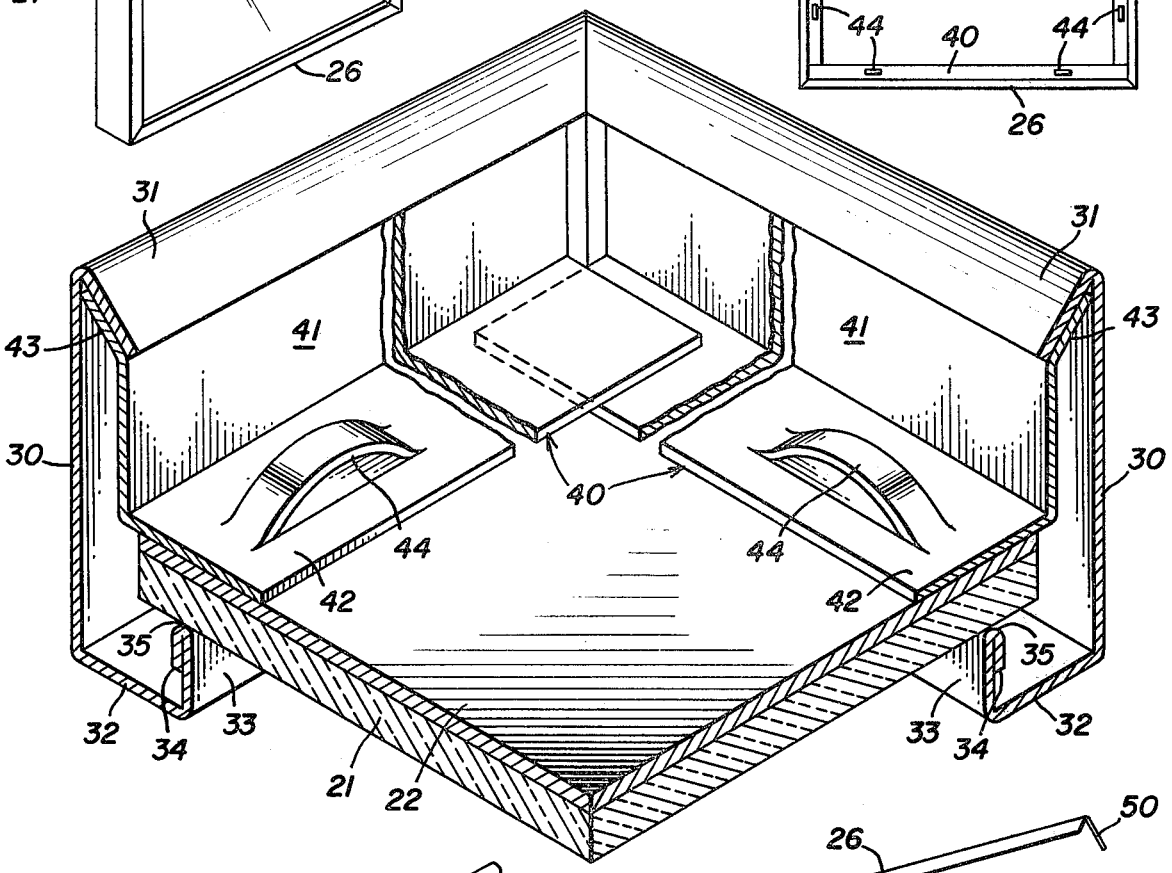
FIG. 3 is an enlarged perspective view looking at the rear of the frame assembly toward one corner thereof.

Turning to FIG. 3, details of the frame 25 and other elements of the frame assembly 20 will be described. Each of the frame members 26 and 27 includes an outside wall 30. A rear wall 31 on the rear of the wall 30 is inclined inwardly and forwardly therefrom. A front lip 32 is on the front of the outside wall 30 and extends inwardly therefrom and is substantially perpendicular thereto. An inside wall 33 on the inner end of the front lip 32 extends rearwardly therefrom and is perpendicular to the lip 32. A fold over portion 34 on the inside wall 33 and in juxtaposition therewith defines a ledge 35 that supports the glass pane 21.

Figure 2:
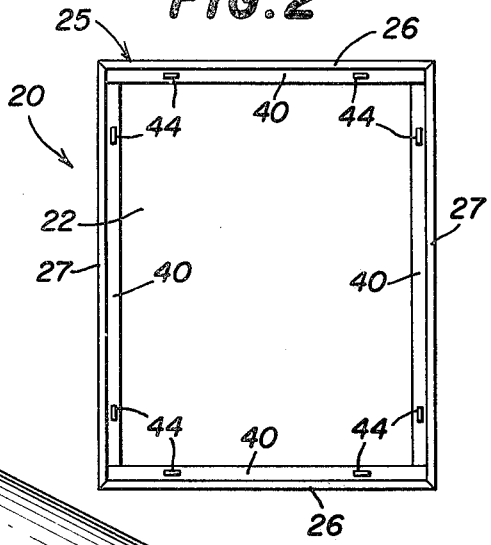
FIG. 2 is a rear elevation view of the frame assembly of FIG. 1.

The frame assembly 20 also comprises a set of four retaining strips 40, each of which retaining strips includes a side wall 41, a flange 42 on the front of the side wall 41 and extending inwardly therefrom, and a tongue 43 on the rear of the side wall 41 inclined outwardly and rearwardly therefrom. The acute angle between the plane of the side wall 41 and the tongue 43 is slightly less than the angle between the outside wall 30 and the rear wall 31. The flange 42 has a width greater than the distance between the inner end of the rear wall 31 and the inside wall 33. The width of the side wall 41 is simply the distance from the inner end of the rear wall 31 to the ledge 35 less the thicknesses of the glass pane 21 and the backing 22. Each of the retaining strips 40 also includes a pair of spaced-apart arch-shaped lugs 44 struck from the flange 42. As can be seen in FIG. 2, the two lugs on one of the side frame members 27 are laterally aligned respectively with the two lugs 44 on the other side frame member 27. Similarly, the lugs 44 on the top end frame member 26 are respectively vertically aligned with the lugs 44 on the bottom end frame member 26.

In the particular embodiment shown, the retaining strips 40 are slightly shorter than the associated frame members 26 and 27. The retaining strips 40 associated with the side frame members 27 resiliently bear on the side margins of the backing 22. The retaining strips 40 associated with the end frame members 26 also resiliently bear on the end margins of the backing 22 except that the ends of these retaining strips overlap the retaining strips along the side. This overlapping construction improves the overall strength of the frame assembly 20.

Figure 4:
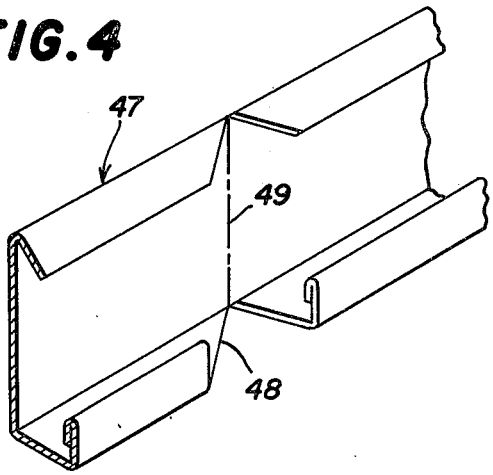
FIG. 4 is a view of a portion of the channel used to make the frame.
Figure 5:
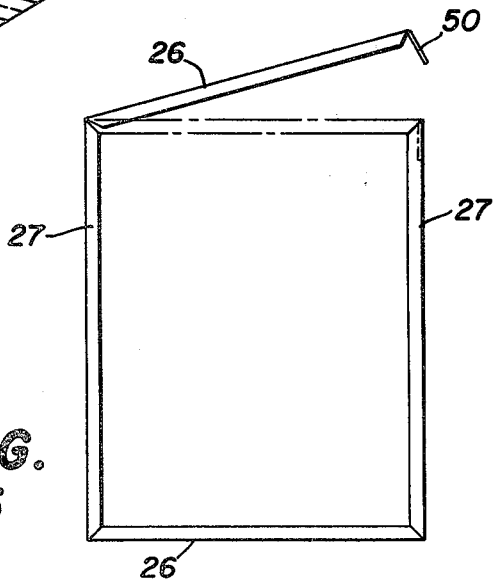
FIG. 5 is a view of the frame prior to positioning and attaching the last frame member.

Turning now to FIGS. 4 and 5, the frame 25 is constructed of a single strip metal 47 of the desired channel-shaped cross section, miter cut at 48 and bent along the line 49 into a frame 25 having miter joints at the corners thereof. In FIG. 5, the fourth of the end frame members 26 is shown in full line just prior to completing the last fold and in phantom after such fold has been completed. A tab 50 on the end of the frame member 26 is attached to the adjacent end of one of the side frame members 27.

Figure 6:
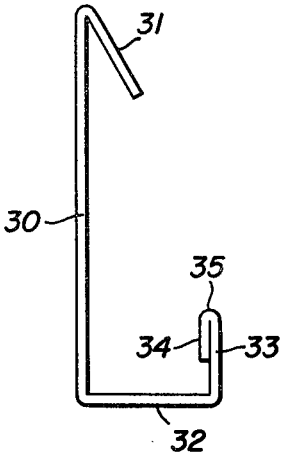
FIG. 6 is an elevation view of one of a frame member.
Figure 7:
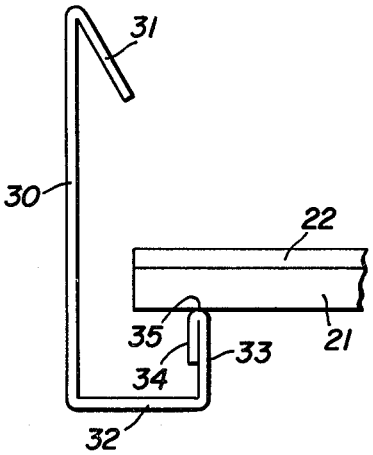
FIG. 7 is a view like FIG. 6, but also showing the glass pane and a backing in place.
Figure 8:
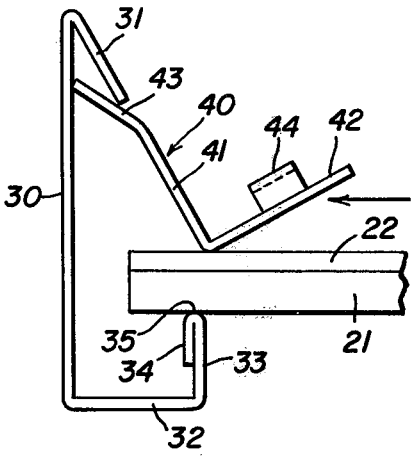
FIG. 8 is a view like FIG. 7 but also showing a retaining strip in the initial stage of application.

Turning now to FIGS. 6–8, the manner in which the elements of the frame assembly 20 are assembled will be described. FIG. 6 shows an elevation view of one of the frame members. The glass pane 21 is dropped in through the back to rest on the ledge 35. The picture (not shown) is then dropped into position, followed by the backing 22. The pane 21 and the backing 22 have dimensions slightly smaller than the distances between the walls 30 of the frame members 26 and 27.

Figure 9:
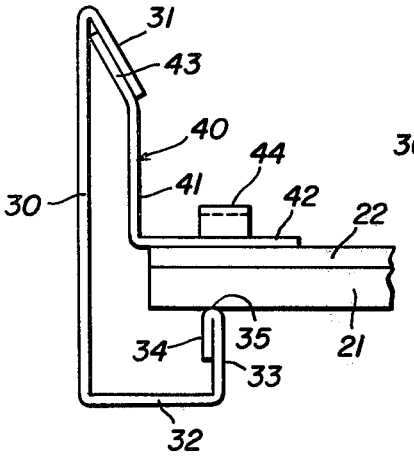
FIG. 9 is a view like FIG. 8 but with the retaining strip applied.

As shown in FIG. 8, a retaining strip 40 is applied first by inserting the tongue 43 in the space between the outside wall 30 and the rear wall 31. The inner end of the rear wall 31 will contact the tongue 43 as shown. Because of the dimensions of the parts, the corner between the side wall 41 and the flange 42 will contact the backing 22. The retaining strip 40 is pushed outwardly, that is, toward the outside wall 30 in the direction of the arrow shown in FIG. 8, causing some slight deformation of the rear wall 31, until the retaining strip 40 snaps into place as shown in FIG. 9 whereupon the tongue 43 will engage the inside surface of the rear wall 31 and the flange 42 will bear against the backing 22. Because the rear wall 31 is biased towards the outside wall 30, the retaining strip 40 is urged forwardly toward the ledge 35 thereby resiliently retaining the backing 22, the glass pane 21 and a picture in position.

Figure 10:
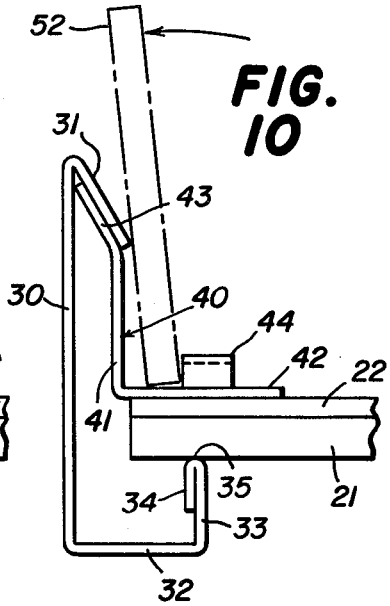
FIG. 10 is a view like FIG. 9 but with a coin in position to remove the retaining strip.
Figure 11:
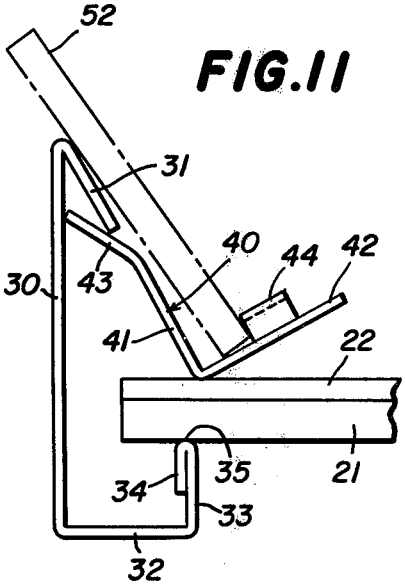
FIG. 11 is a view like FIG. 10 but with the retaining strip in an intermediate position preparatory to being removed.

Turning now to FIGS. 10 and 11, the mannner in which the retaining strips are detached will be explained. In FIG. 10, there is shown in phantom an elevation view of a coin 52 which is a simple tool to be used in the removal process. The coin is inserted between the side wall 41 and the lug 44 and then rotated in the direction of the arrow, that is, counterclockwise, until it contacts the inner end of the rear wall 31, which inner end constitutes a fulcrum. Further force exerted on the outer end of the coin 52 will cause same to rotate about such fulcrum and to push the lug 44 and thus the retaining strip 40 inwardly to the position shown in FIG. 11. In such condition, the retaining strip may be very simply removed. The backing 22 and the pane 21 or either of them can be removed to change the picture or the like. The procedure just described normally will be repeated with respect to the other lug 44 to remove the entire retaining strip. The same procedure is performed in respect to the other three retaining strips, one after another. Obviously, the retaining strips 40 which overlap, that is, those associated with the end frame members 26 in the embodiment shown in FIG. 2 will be removed first.

Figure 12:
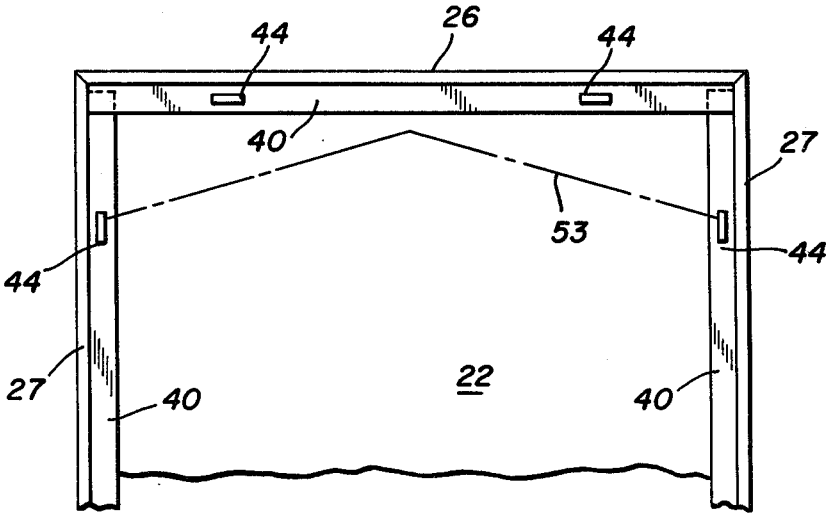
FIG. 12 is a rear elevation view of the frame assembly showing a hanging wire in phantom.

While the fundamental purpose of the lugs 44 is to facilitate removal of the retaining strips 40, they have another purpose. As shown in FIG. 12, the phantom line represents a hanging wire 53 attached to laterally aligned lugs 44. Depending upon the orientation of the picture to be mounted in the frame assembly 20, the hanger wire 53 can be attached to any one of the four pairs of lugs 44.

While the frame assembly 20 has been described in the context of use with a glass pane 21 and a backing 22, and with a picture therebetween, it is to be understood that the invention is usable in other environments such as to mount a painting or to display an item having some three-dimensional aspects. Furthermore, in some instances, a glass pane may not be necessary and/or a backing may not be necessary. In other instances, some filler material for one reason or another may be utilized. The retaining strip 40 is designed to correspond to a frame with certain dimensions, that is, one utilizing a glass pane. If it is desired not to use the glass pane, or to use a glass pane of substantially different thickness, then some filler material may be used to compensate for the lack of the pane.

Because of the sandwich effect of the retaining strips 40 in association with the frame 25, the frame assembly 20 has unusual strength and resistance to bending. The frame assembly 20 is therefore well suited to be made in large sizes to mount large art reproductions, for example. Also, the frame assembly 20 is inexpensive to make as it can be formed of sheet metal bent as described. Because it is made of sheet metal, it is much lighter than a frame extruded of solid material would be. The retaining strips 40 are applied without the use of tools yet producing a strong frame assembly. These retaining strips 40 are removed with a coin or the like.

We claim:

1. A frame assembly for displaying a picture or the like and comprising a frame having a pair of end frame members and a pair of side frame members, each of said frame members including an outside wall having a rear and a front, a rear wall on the rear of said outside wall and being inclined inwardly and forwardly therefrom, a front lip on the front of said outside wall and extending inwardly therefrom, and an inside wall on the inside of said front lip and extending rearwardly therefrom, the rear of said inside wall being located forwardly of the front of said rear wall and defining a ledge for means including the picture; and at least two retaining strips respectively associated with two of said frame members, each of said retaining strips including a side wall having a front and a rear, a flange on the front of said side wall and extending inwardly therefrom, and a tongue on the rear of said side wall and being inclined outwardly and rearwardly therefrom, each of said retaining strips being applied by inserting its tongue in the space between the associated outside and rear walls and then pushing said retaining strip toward the associated outside wall until the associated flange rests on the rear of the means.

2. The frame assembly of claim 1, wherein said frame is of one-piece construction.

3. The frame assembly of claim 1, wherein said frame is constructed of one piece of sheet metal.

4. The frame assembly of claim 1, wherein said end frame members are parallel to each other and said side frame members are parallel to each other.

5. The frame assembly of claim 1, wherein said inside wall and said outside wall are parallel.

6. The frame assembly of claim 1, wherein said front lip is substantially parallel to said inside wall and to said outside wall.

7. The frame assembly of claim 1, wherein each of said retaining strips further includes a fold-over portion of said inside wall in juxtaposition therewith.

8. The frame assembly of claim 1, comprising four of said retaining strips respectively associated with said frame members.

9. The frame assembly of claim 1, wherein said flange is substantially perpendicular to said side wall.

10. The frame assembly of claim 1, wherein each of said retaining strips further includes at least one lug to facilitate removal of said strips.

11. The frame assembly of claim 10, wherein each of said lugs is constructed to anchor a hanger wire.

12. The frame assembly of claim 1, wherein each of said retaining strips further includes two longitudinally spaced-apart lugs on the associated flange to facilitate removal of said retaining strips and to anchor hanger wires.

13. The frame assembly of claim 12, wherein each of said lugs is arch shaped and is struck from the associated flange.

14. A frame assembly for displaying a picture or the like and comprising a frame having a pair of end frame members and a pair of side frame members, each of said frame members including an outside wall having a rear and a front, a rear wall on the rear of said outside wall and being inclined inwardly and forwardly therefrom, a front lip on the front of said outside wall and extending inwardly therefrom, and an inside wall on the inside of said front lip and extending rearwardly therefrom, the rear of said inside wall being located forwardly of the front of said rear wall and defining a ledge for means including the picture; and four retaining strips respectively associated with said frame members, each of said retaining strips including a side wall having a front and a rear, a flange on the front of said side wall and extending inwardly therefrom, and a tongue on the rear of said side wall and being inclined outwardly and rearwardly therefrom, each of said retaining strips being applied by inserting its tongue in the space between the associated outside and rear walls and then pushing said retaining strip toward the associated outside wall until the associated flange rests on the rear of the means, said retaining strips having lengths such that their ends overlap.

15. The frame assembly of claim 14, wherein each of said retaining strips further includes two longitudinally spaced-apart lugs on the associated flange to facilitate removal of said retaining strips and to anchor hanger wires.

* * * * *